US005257480A

United States Patent [19]

Carpenter

[11] Patent Number: 5,257,480

[45] Date of Patent: Nov. 2, 1993

[54] BATTING WHEEL AND VANES FOR THE SAME

[75] Inventor: James H. Carpenter, Hagerstown, Md.

[73] Assignee: Pangborn Corporation, Hagerstown, Md.

[21] Appl. No.: 532,644

[22] Filed: Jun. 4, 1990

Related U.S. Application Data

[63] Continuation-in-part of Ser. No. 48,940, May 12, 1987, Pat. No. 4,941,296.

[51] Int. Cl.[5] ..... B24C 5/06

[52] U.S. Cl. ..... 51/435

[58] Field of Search ..... 51/435, 434, 433, 432, 51/431, 429, 428; 241/275; 416/219 AR, 204 R, 220 A

[56] References Cited

U.S. PATENT DOCUMENTS

| | | | |
|---|---|---|---|
| 2,225,482 | 12/1940 | Mulvany | 51/431 |
| 2,810,513 | 10/1957 | McVeigh | 416/220 A |
| 4,176,502 | 12/1979 | Leliaert | 51/435 |
| 4,473,972 | 10/1984 | Leliaert | 51/435 |
| 4,669,164 | 6/1987 | Phelps | 416/219 A |
| 4,751,798 | 6/1988 | McDade | 51/434 |

FOREIGN PATENT DOCUMENTS

| | | | |
|---|---|---|---|
| 0181573 | 10/1983 | Japan | 51/431 |

*Primary Examiner*—Robert A. Rose
*Attorney, Agent, or Firm*—Charle E. Brown

[57] ABSTRACT

This relates to a batting wheel particularly useful in a surface cleaner for batting abrasive particles against a surface to be cleaned. The batting wheel includes a hub which carries a plurality of axially spaced collars. At the ends of the batting wheel there are vane retaining plates of which at least one is removable so as to facilitate the removal and replacement of vanes. Each vane includes a flat blade and a retaining enlargement at the radially inner end of the flat blade. The collars are provided with axially aligned, circumferentially spaced slots for receiving the anchoring portion of a vane with each vane having an enlargement which is received in an enlarged opening in the respective collar. The enlarged opening is disposed at the inner end of a slot which receives an axially inner end of the flat blade. This permits the opposite batting faces of the flat blade to be selectively presented for batting abrasive particles.

7 Claims, 1 Drawing Sheet

BATTING WHEEL AND VANES FOR THE SAME

This application is a continuation-in-part of my U.S. application Ser. No. 07/048,940 filed May 12, 1987 now U.S. Pat. No. 4,941,296.

This invention relates in general to new and useful improvements in batting wheels, and more particularly to a batting wheel which is provided with replaceable vanes.

In accordance with this invention, there is provided a batting wheel which includes a hub and which hub carries a plurality of annular collars disposed in axially spaced relation. The collars are provided with axially aligned radial slots spaced circumferentially around the collars. Each radial slot terminates at its inner end in an enlarged opening.

In accordance with this invention, replaceable vanes are carried by the batting wheel with each vane including a generally flat blade portion having a mounting end with the mounting end being in the form of an anchoring enlargement.

Further in accordance with this invention, the anchoring enlargement of the vane may be varied in shape and may project to one side only of the flat blade portion or to both sides thereof.

With the above and other objects in view that will hereinafter appear, the nature of the invention will be more clearly understood by reference to the following detailed description, the appended claims, and the several views illustrated in the accompanying drawings.

Figure 1:
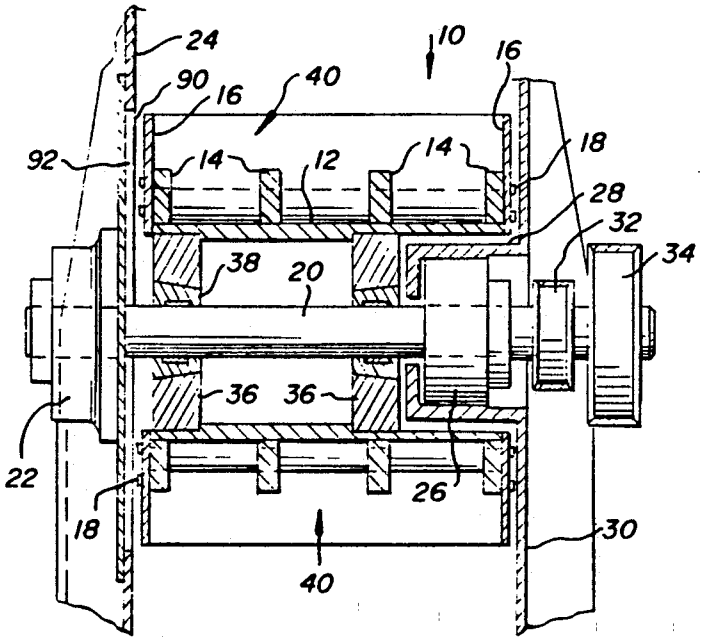
FIG. 1 is a sectional view taken through the batting wheel and shows generally the construction thereof and the manner in which it is mounted.
Figure 2:
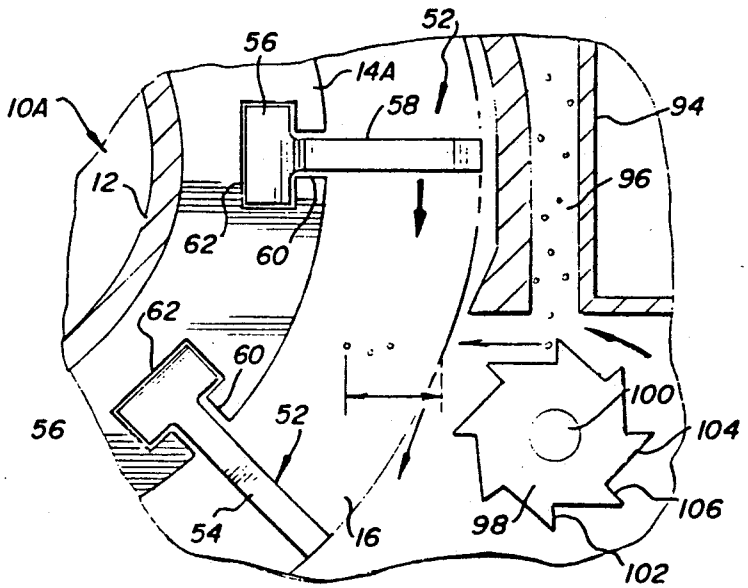
FIG. 2 is an end elevational view of the batting wheel with one end plate removed showing the manner in which the batting wheel vanes are replaced and illustrating one form of vane.

Referring now to the drawings in detail, reference is first made to FIGS. 1 and 2 wherein there is illustrated a batting wheel formed in accordance with this invention, the batting wheel being generally identified by the numeral 10. The batting wheel 10 includes a cylindrical hub 12 which is provided with a plurality of axially spaced annular collars 14 which are rigidly attached to the hub 12. The collars 14 serve as supports or carriers for vanes as will be described in detail hereinafter.

The batting wheel 10 also includes a pair of end plates 16 of which at least one is removably attached to an associated collar 14 by way of fasteners 18.

The batting wheel 10 is carried by a shaft 20 which is supported for rotation by a bearing unit 22 mounted outside of a housing portion 24. The opposite end of the shaft 20 is mounted for rotation in a bearing 26 which is mounted within a recessed portion 28 of a housing portion 30. Suitable drive pulleys 32, 34 are mounted on the right end of the shaft 20.

The batting wheel 10 is mounted on the shaft 20 by way of a pair of axially spaced support members 36 which are provided with telescoping inserts 38.

Figure 3:
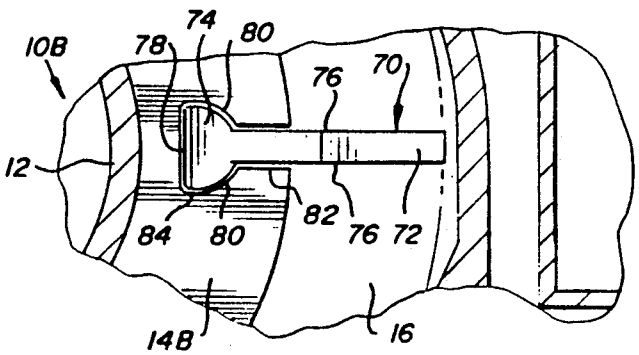
FIG. 3 is a fragmentary sectional view showing another batting wheel vane and the manner in which it is mounted within the batting wheel.

Referring now to FIGS. 1 and 3, it will be seen that the batting wheel 10 carries a plurality of vanes 40.

Each vane 40 includes a flat blade portion 42 having opposite working faces 44. The vane 40 is provided with an anchoring enlargement 46 at the inner end thereof. The anchoring enlargement 46 is generally semi-circular in outline and projects only from one of the faces 44, the other of the faces 44 extending to the extreme end of the vane 40.

In order that the vanes 40 may be conveniently mounted on the batting wheel 10, each of the collars 14 is provided with a plurality of circumferentially spaced radially extending slots 48 which opens through the outer face of each collar 14 and which terminates at its inner end in an enlarged opening 50. It will be seen that the opening 50 is generally circular in outline so as to match the semi-circular enlargement 48.

It is also to be noted that each of the vanes 40 is not only positioned relative to the batting wheel 10 by way of the anchoring enlargement 46, but also by way of inner portions of the flat blade 42 being positioned in respective slots 48 for engagement therewith.

Further, it will be seen that after one of the faces 44 wears due to the batting of abrasive particles as will be described hereinafter, the vane 40 may be slid out of the collars 14, turned end for end and reinserted so that the anchoring enlargement 46 will now be in the lower portion of the opening 50 and the previously unused batting face 44 will be disposed lowermost in position to bat abrasive particles in accordance with the invention.

Reference is now made to FIG. 2 wherein there is illustrated a modified form of batting wheel generally identified by the numeral 10A. The batting wheel 10A differs from the batting wheel 10 only in the details of its collars 14A and more particularly in the details of the slots for mounting a modified form of batting vane, generally identified by the numeral 52. Each batting vane 52 includes a flat blade 54 which is provided at the radial inner end thereof with an enlarged head 56 which provides for a generally T-formation. The head 56 is generally rectangular in cross section. The flat blade 54 has opposite batting faces 58.

In order that the vane 52 may be readily mounted in the collars 14A, the collar 14A is provided at circumferentially spaced intervals with radial slots 60 that terminate at the inner ends in enlarged openings 62. The openings 62 are generally rectangular in outline so as to match the head 56.

It will be readily apparent that the vanes 52 are mounted within the collars 14A in the same manner as the vanes 40 are mounted within the collar 14. It will also be apparent that after one of the batting faces 58 of the flat blade 54 becomes worn, the vane 52 may be slid axially out of the collars 14A, turned end for end and reinserted so that the opposite face of the flat blade becomes available for use.

Finally, it is pointed out that a radially inner portion of the flat blade 54 is positioned within its associated slots 60 and forms part of the means for connecting the blade 52 to the batting wheel 10A.

Figure 4:
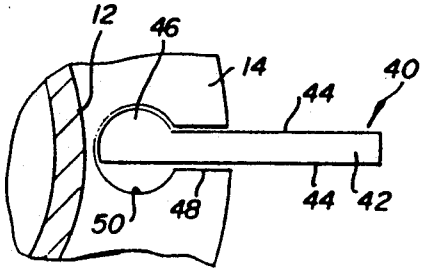
FIG. 4 is yet another sectional view taken through the batting wheel and shows still another form of batting vane.

Reference is now made to FIG. 4 wherein there is illustrated still another slightly modified form of batting wheel generally identified by the numeral 10B. The batting wheel 10B is of a like-construction with that of the batting wheel 10 except for the specific slot construction of modified collars 14B and the specific cross section of the anchoring part of an associated vane generally identified by the numeral 70. The vane 70 includes a flat blade 72 which terminates in an enlarged anchoring end 74. The anchoring end 74 is of a generally semi-circular cross section and extends equally to opposite sides of the flat blade 72. The flat blade 72 has batting faces 76 while the enlargement 74 is of a maximum thickness at an end 78 thereof. Opposite surfaces of the enlargement 74 are convexly curved as at 80.

As in the case of other collars, the collar 14B is provided with a plurality of circumferentially spaced axially extending slots 82 which receive the radially inner part of the flat blade 72. The slot 82 radially terminates in an enlarged opening 84 of a semi-circular cross section so as to match the general outline of the enlargement 74.

It is to be understood that the vanes 70 are slid through the collars 14B when they are being installed or removed and that after one of the batting faces 76 thereof has become worn, the vane 70 is removed from the batting wheel 10B, turned end for end and replaced with the result that the other of the batting faces 76 is now in the operative position.

Returning once again to FIG. 1, it will be seen that the housing 24 is provided with an enlarged opening 90 through which access to the batting wheel is obtained. This opening is closed by a cover plate 92 which carries the bearing 22. By removing the cover plate 92 and the bearing 22, the adjacent end plate 16 may be removed so as to effect replacement of the vanes.

Referring now to FIG. 2, it will be illustrated the general mode of operation of the batting wheel with reference being made to the illustrated batting wheel 10A. The housing of the machine, a surface cleaner, of which the batting wheel is a part includes a portion 94 defining a passageway 96 through which abrasive particles are free to drop. Below the passageway 96 is an accelerator wheel 98 carried by a shaft 100 which may be driven from the shaft 20. The accelerator wheel 98 is provided with a plurality of circumferentially spaced teeth 102 with the number of teeth 102 matching the number of vanes 54. Each tooth 102 defines a flat 104 on which abrasive particles fall and a shoulder 106 at the end of the flat 104 so as to assure the batting of abrasive particles into the path of the rotating vanes.

It is to be understood that there is one tooth 102 for each of the vanes of the batting wheel and that the teeth 102 bat abrasive particles into the path of the vanes in timed relation to the rotation of the vanes by the batting wheel.

Although only several preferred embodiments of vanes and the manner of attaching the vanes to a batting wheel have been specifically illustrated and described herein, it is to be understood that minor variations may be made in the batting wheel structure and the vanes without departing from the spirit and scope of the invention as defined by the appended claims.

I claim:

1. A vane for a batting wheel, said vane comprising a flat blade portion having a mounting end including an anchoring enlargement extending from and beyond an extreme end of said flat blade portion, said vane being of a one piece rigid solid metal construction with said flat blade portion having opposite working faces forming means for engaging abrasive particles and being subject to wear, and said anchoring enlargement projecting from only one of said faces.

2. A vane according to claim 1 wherein said flat blade includes a portion adjacent said anchoring enlargement forming part of said mounting end.

3. A vane for a batting wheel, said vane comprising a flat blade portion having a mounting end including an anchoring enlargement extending from and beyond an extreme end of said flat blade portion, said vane being of a one piece rigid solid metal construction with said flat blade portion having opposite working faces forming means for engaging abrasive particles and being subject to wear to the extent that a first worn out working face of a vane must be replaced and may be replaced by the other of said working faces, and said anchoring enlargement projects directly from both of said faces.

4. A vane for a batting wheel, said vane comprising a flat blade portion having a mounting end including an anchoring enlargement extending from and beyond an extreme end of said flat blade portion, said vane being of a one piece rigid solid metal construction with said flat blade portion having opposite working faces forming means for engaging abrasive particles and being subject to wear to the extent that a first worn out working face of a vane must be replaced and may be replaced by the other of said working faces, and said anchoring enlargement projects directly from both of said faces, said anchoring enlargement having a maximum thickness at an extreme end of said anchoring enlargement remote from said flat portion and said anchoring enlargement curves in decreasing thickness towards said flat blade.

5. A vane according to claim 4 wherein said curve is convex.

6. A vane according to claim 3 wherein said anchoring enlargement includes an axial continuation of said flat blade portion and is T-shaped.

7. A vane according to claim 3 wherein said anchoring enlargment includes an axial continuation of said flat blade portion and is T-shaped, and of a constant thickness.

* * * * *